US009234731B2

(12) United States Patent
Keska

(10) Patent No.: US 9,234,731 B2
(45) Date of Patent: Jan. 12, 2016

(54) CARTRIDGE CASE PROCESSING DEVICE

(71) Applicant: Wojciech Keska, Wallenhorst (DE)

(72) Inventor: Wojciech Keska, Wallenhorst (DE)

( * ) Notice: Subject to any disclaimer, the term of this patent is extended or adjusted under 35 U.S.C. 154(b) by 0 days.

(21) Appl. No.: 14/520,365

(22) Filed: Oct. 22, 2014

(65) Prior Publication Data

US 2015/0159985 A1 Jun. 11, 2015

(30) Foreign Application Priority Data

Dec. 10, 2013 (DE) ..... 10 2013 020 748

(51) Int. Cl.
*F42B 33/10* (2006.01)
*F42B 35/02* (2006.01)

(52) U.S. Cl.
CPC ..... *F42B 33/10* (2013.01); *F42B 35/02* (2013.01)

(58) Field of Classification Search
CPC ..... F42B 33/04; F42B 33/10; B23B 5/168
USPC ..... 86/19.7, 24, 19.6, 23, 28, 33, 37, 40; 409/131
See application file for complete search history.

(56) References Cited

U.S. PATENT DOCUMENTS

| | | | | |
|---|---|---|---|---|
| 3,174,390 | A * | 3/1965 | Jacobsen | F42B 35/02 86/19.7 |
| 3,555,641 | A * | 1/1971 | Lee | F42B 33/10 102/464 |
| 4,325,282 | A | 4/1982 | Schaenzer | |
| 4,653,157 | A * | 3/1987 | Alexander | B23B 5/168 408/14 |
| 5,125,316 | A | 6/1992 | Markle | |
| 5,180,260 | A | 1/1993 | Phillips, Sr. | |
| 5,309,813 | A | 5/1994 | Henley | |
| 5,635,661 | A | 6/1997 | Tuftee | |
| 5,649,465 | A | 7/1997 | Beebe | |
| 6,101,915 | A | 8/2000 | Sinclair | |
| 7,650,825 | B1 * | 1/2010 | Lee | B23B 5/165 86/19.7 |
| 7,681,481 | B1 | 3/2010 | Buckley | |
| 8,827,607 | B1 * | 9/2014 | Goodman | B23B 5/168 408/202 |
| 2011/0232467 | A1 * | 9/2011 | Keska | F42B 35/02 86/24 |

* cited by examiner

*Primary Examiner* — Samir Abdosh
*Assistant Examiner* — John D Cooper
(74) *Attorney, Agent, or Firm* — David P. Dickerson

(57) ABSTRACT

The present disclosure relates to a cartridge case processing device to produce and prepare empty cartridge cases (2) comprising a trimmer holder (6) in which a die body (14) is received in the lower section (6.1) and in an upper section (6.2) a bushing (25, 25.1) guided shaft (5) is received on which a cutter (12), an expander die (3) and a decapping pin (15) are coaxially arranged characterized by the integration of an adjusting nut (26) coaxial with the shaft (5) in the upper section (6.2) of the trimmer holder (6), which when turned relative to the shaft (5) leads to the position of the cutter (12) being adjusted in an axial direction.

19 Claims, 5 Drawing Sheets

30
28
27
26
19
18
29
30
26
27
19
18

CARTRIDGE CASE PROCESSING DEVICE

BACKGROUND OF THE DISCLOSURE

1. Field of the Disclosure

This invention relates to a cartridge case processing device for producing, preparing or refurbishing empty cartridge cases.

2. Description of the Related Art

High levels of dimensional accuracy are demanded when preparing cartridge cases, in particular for precision ammunition. Firing a cartridge case leads to an increase in its diameter along its entire length as well as to a linear expansion of the cartridge case. A cartridge case deformed by firing the cartridge must be refurbished to a suitable shape to be reused.

In view of the aforementioned prior art, it is the object of the present disclosure to provide a cartridge case processing device for producing, preparing and/or refurbishing empty cartridge cases that allows simple tool-free handling, while simultaneously facilitating precise tooling of the cartridge case.

SUMMARY OF THE PRESENT DISCLOSURE

According to the present disclosure, a trimming and sizing device to produce and prepare empty cartridge cases comprising a trimmer holder in which a die body is received in the lower section and in an upper section a bushing guided shaft is received on which a cutter, an expander die and a decapping pin are coaxially arranged is characterized by the integration of an adjusting nut coaxial with the shaft in an opening in the upper section of the trimmer holder, which when turned relative to the shaft leads to a relative movement of bushing relative to the upper section. The adjusting nut is accessible from the outside of the upper section. When the adjusting nut is turned relative to the shaft it leads to the position of the cutter being adjusted in an axial direction.

The trimmer holder accommodates all of the components required to trim and calibrate a cartridge case. By turning the adjusting nut integrated in the trimmer holder in a clockwise or counterclockwise direction it is possible to finely adjust the position of the cutter without the need for any tools. The arrangement of the adjusting nut projecting partially above the trimmer holder in a radial direction allows easy access for its operation. Turning the adjusting nut results in a relative movement of the bushing relative to the trimmer holder so that the position of the shaft together with the cutter mounted on the shaft is altered in an axial direction to facilitate carrying out the trimming process with the greatest possible precision. In this manner it is possible to adjust the final position of the cutter simply, conveniently and at the same time with extreme precision.

This design embodiment sees the adjusting nut joined to the bushing by means of the external thread of the bushing. The adjustment distance traveled by the bushing as a result of turning the adjusting nut is directly proportional to the lead of the external thread of the bushing or rather the corresponding internal thread of the adjusting nut. The axial position of the bushing relative to the upper section of the trimmer holder, which serves as an end stop for the axial movement of the cutter when trimming, is altered relative to the shaft. Consequently, it is easily possible to determine precisely the final position the cutter reaches when trimming the neck section of the cartridge case.

The trimmer holder is connected to a loading press by means of the die body received in the lower section. The die body is partially screwed into the lower section of the trimmer holder. The die body is partially screwed into the loading press. It is in this manner that the loading press and the trimmer holder are joined together.

A favorable aspect of the design embodiment is that it is possible for the adjusting nut to partially protrude out of the upper section of the trimmer holder in a radial direction. This makes it possible to manually operate the adjusting nut easily and surely.

A further embodiment lies in the possibility of adjusting the adjusting nut step-by-step or infinitely variably. Adjusting the axial position of the cutter for fine adjustment purposes instead of infinitely variable adjustment simplifies the trimming process with reproducible settings, and prevents unintentional maladjustment of the position of the cutter that does not correspond to the length the cartridge case is to be shortened in accordance with the caliber. However, infinitely variable adjustability means it is possible to set the position of the cutter to any setting.

In particular, a locking element is arranged in the upper section of the trimmer holder that can be form-lock engaged with the adjusting nut. The adjusting nut is held in the respective position by means of the locking element so that operating the trimming and sizing device does not alter the undertaken fine adjustment of the cutter when performing the trimming operation. This has the added advantage that the operating person is able to sense that a further step has been undertaken to finely adjust the cutter based on the form-locked engagement.

In doing so, the locking element is applied with pressure induced by means of a spring element against a radially outward extending surface of the adjusting nut provided with recesses. As a consequence, when setting the cutter by turning the adjusting nut it is necessary to overcome a mechanical resistance. That prevents unintentional maladjustment on the one hand and better retains the individually undertaken steps to make settings on the other.

Ideally, the recesses are interposed by intermediate, plane surfaces. Thus, when the adjusting nut is turned the locking element slides over the plane surface when moving from one recess to the next, which means an individual step can be heard and felt when the locking element again reaches a corresponding recess.

The locking element is preferably provided with an at least partially curved surface with which the locking element can engage in one of the recesses.

The locking element is preferably designed in the form of a ball. To press the ball against the underside of the adjusting nut with constant pressure, a dedicated spring element designed in the form of a coiled spring is assigned to the ball to apply a pressure force to the ball. For this purpose a blind hole has been sunk in the upper section of the trimmer holder parallel to the axis of the shaft, which serves to accommodate the spring element designed in the form of a coiled spring as well as the locking element designed in the form of a ball.

In the following the invention is explained in more detail with reference to the accompanying drawings. The depicted examples of embodiment do not represent any limitation to the depicted versions, but serve solely to explain a principle of the invention. The same or similar components are indicated with the same reference numbers. In order to be able to illustrate the mode of operation according to the invention highly simplified schematic representations only are depicted in the figures, while no components are depicted that are of no essential significance to the invention. Nevertheless, that does not mean that such components are not present in a solution according to the invention.

DETAILED DESCRIPTION

Figure 1:
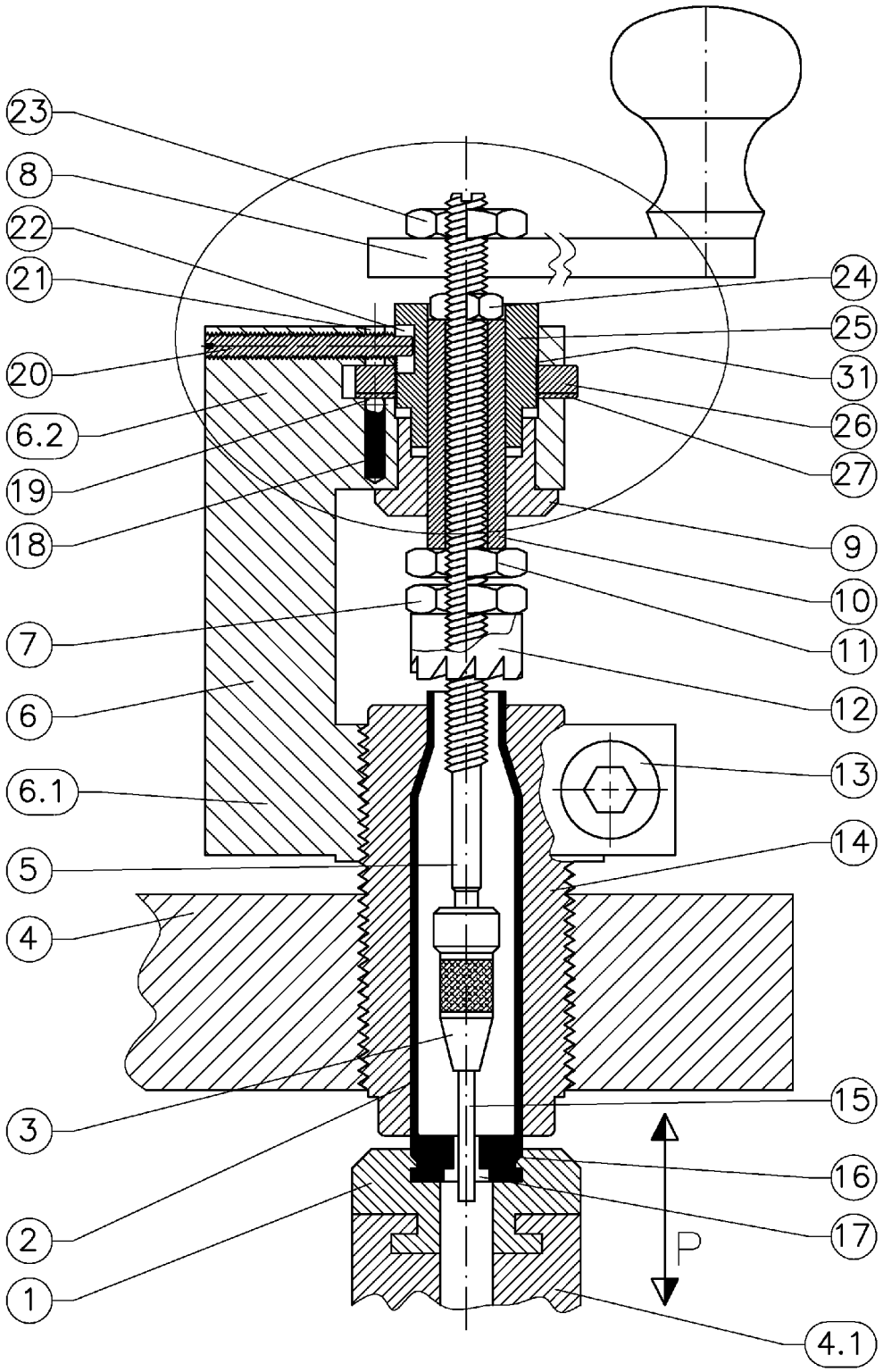
FIG. 1 A sectional view of a trimming and sizing device

A sectional view of a trimming and sizing device is depicted in FIG. 1. A loading press, of which just a holder arm section is partially visible, is denoted by the reference numeral 4. The loading press 4 serves to receive the trimming and sizing device, which includes a die body 14 and other components. The die body 14 has a hollow interior into which a cartridge case 2 can be inserted. The die body 14 is provided with an external thread with which it is possible to screw the die body 14 into a corresponding threaded section of the holder arm section of the loading press 4. The base 16 of the cartridge case 2 is fixed in position by a case holder 1 into which it is possible to temporarily secure the cartridge case 2. As indicated by the arrow P the case holder 1 can be moved in a vertical direction by means of a pressing ram 4.1, which is part of the loading press 4.

The die body 14 is partially screwed into a lower, horizontally extending section 6.1 of an essentially C-shaped trimmer holder 6. For this purpose the lower section 6.1 of the trimmer holder 6 has a through hole with an internal threaded section. A clamping screw 13 serves to squeeze together or loosen the slotted section 6.1 of the trimmer holder 6 so that the position of the die body 14 can be adjusted in the trim holder 6 by means of the external thread. The die body 14 joins the trimmer holder 6 to the loading press 4. An upper section 6.2, which is provided with a through hole, of the trimmer holder 6 extends parallel to the lower section 6.1. The upper section 6.2 of the trimmer holder 6 serves to receive a threaded rod 5 that is at least in part provided with a thread, which in turn can be rotated by means of a crank handle 8 arranged on one end of the threaded rod 5. The crank handle 8 is secured on the threaded rod 5 by means of lock nut 23. Viewed in the direction of the die body 14 a cutter 12 is arranged coaxially with the threaded rod 5 and secured with a lock nut 7. The cutter 12 is screwed onto the threaded rod 5. Below the cutter 12 there is an expander die 3 to which a decapping pin 15 is attached. The expander die 3 and the decapping pin 15 can be designed as a single component. However, it is advantageous when the expander die 3 and the decapping pin 15 are implemented as separate components, so that it is easily possible to replace the decapping pin 15 when necessary. To achieve a coaxial arrangement on the threaded rod 5 the cutter 12, the expander die 3 as well as the decapping pin 15 are screwed separately from one another onto a threaded section, not shown, of the threaded rod 5. This arrangement results in the essential advantage that the individual production-related tolerances of the cutter 12, expander die 3 as well as the decapping pin 15 do not stack up as is the case with elements screwed into one another.

The crank handle 8 is arranged on the threaded rod 5 above the upper section 6.2 of the trimmer holder 6. To provide rotatable support of the threaded rod 5 this is partially enclosed by a plain bush 10. A lower part of the plain bush 10 that faces away from the crank handle 8 is received in a stop bushing 9 with a flange-shaped edge. The flange-shaped edge of the stop bushing 9 is supported on its underside of the upper section 6.2 of the trimmer holder 6. An upper part of the plain bush 10 that faces towards the crank handle 8 is received in a bushing 25 provided with an external threaded section 31. There is a lock nut, 11 and 24, located at both respective ends of the plain bush 10.

Figure 2:
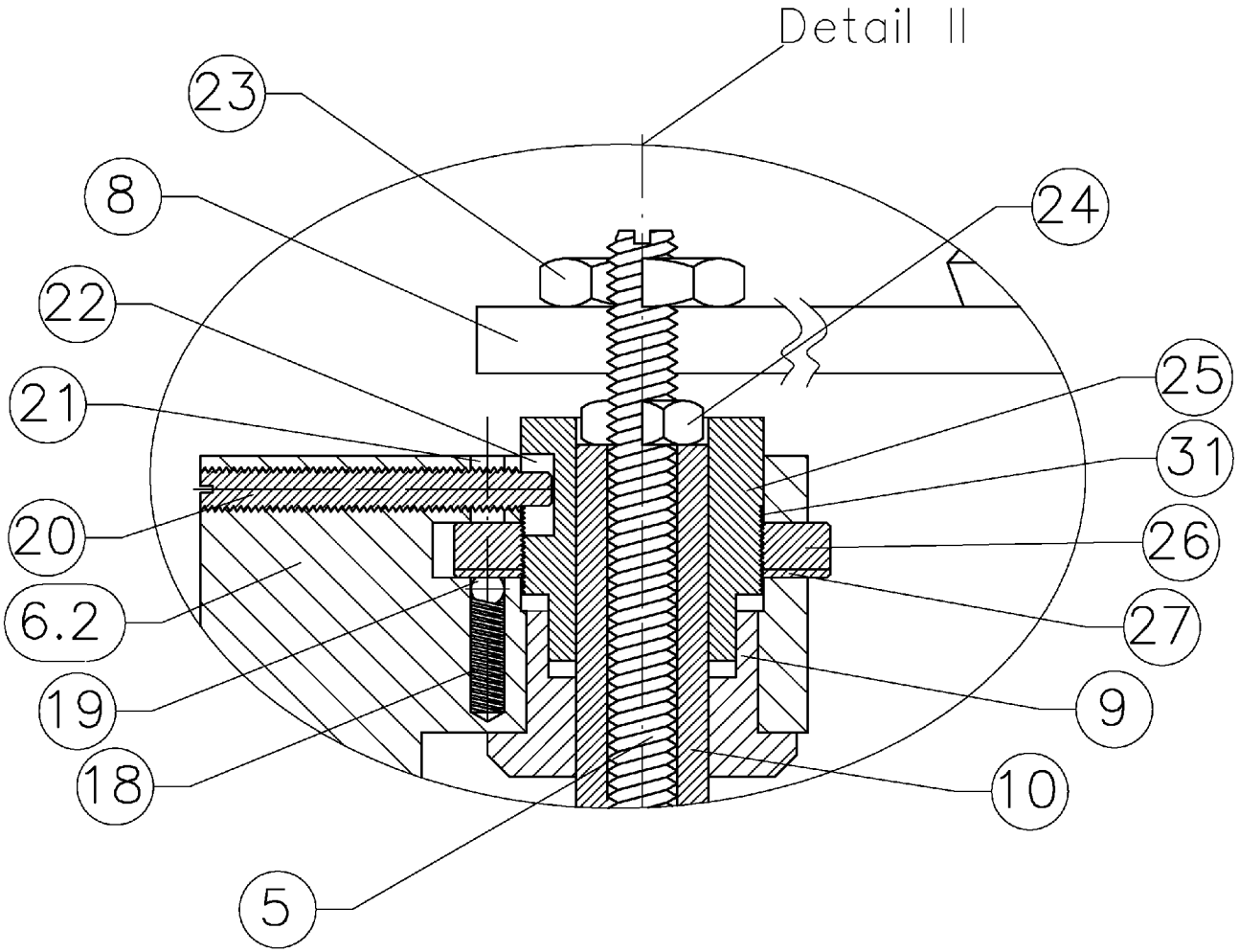
FIG. 2 A detailed view II of an upper section of a trimmer holder of the trimming and sizing device as per FIG. 1

In FIG. 2 there is a detailed view II depicting an upper section 6.2 of a trimmer holder 6 of the trimming and sizing device as per FIG. 1. The drawing in FIG. 3 shows an enlarged view of the detailed view II as per FIG. 2; however, to achieve a better representation FIG. 3 dispenses with an illustration of the upper section 6.2 of the trimmer holder 6.

Figure 3:
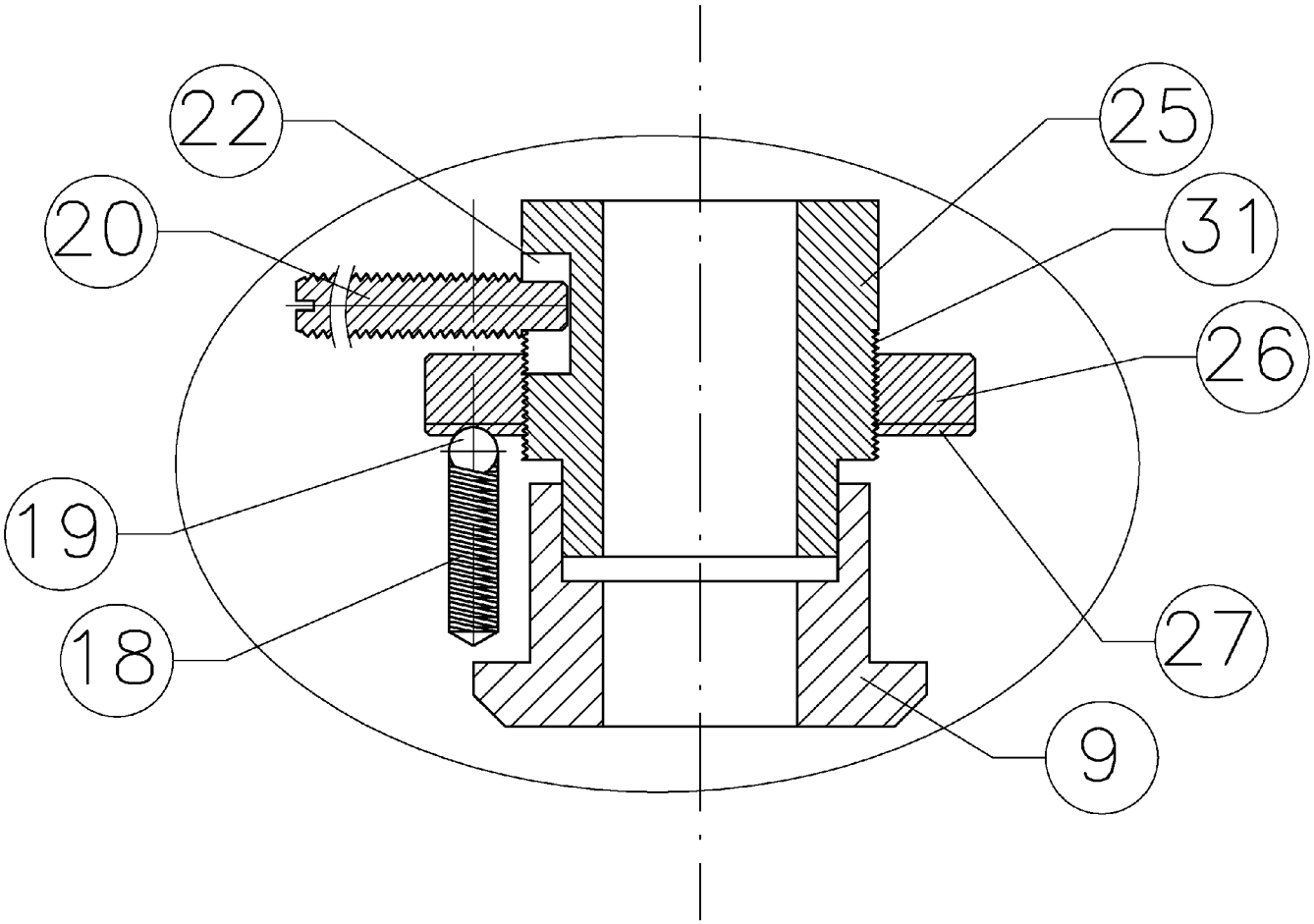
FIG. 3 Enlarged view of detailed view II as per FIG. 2
Figures 5, 6:
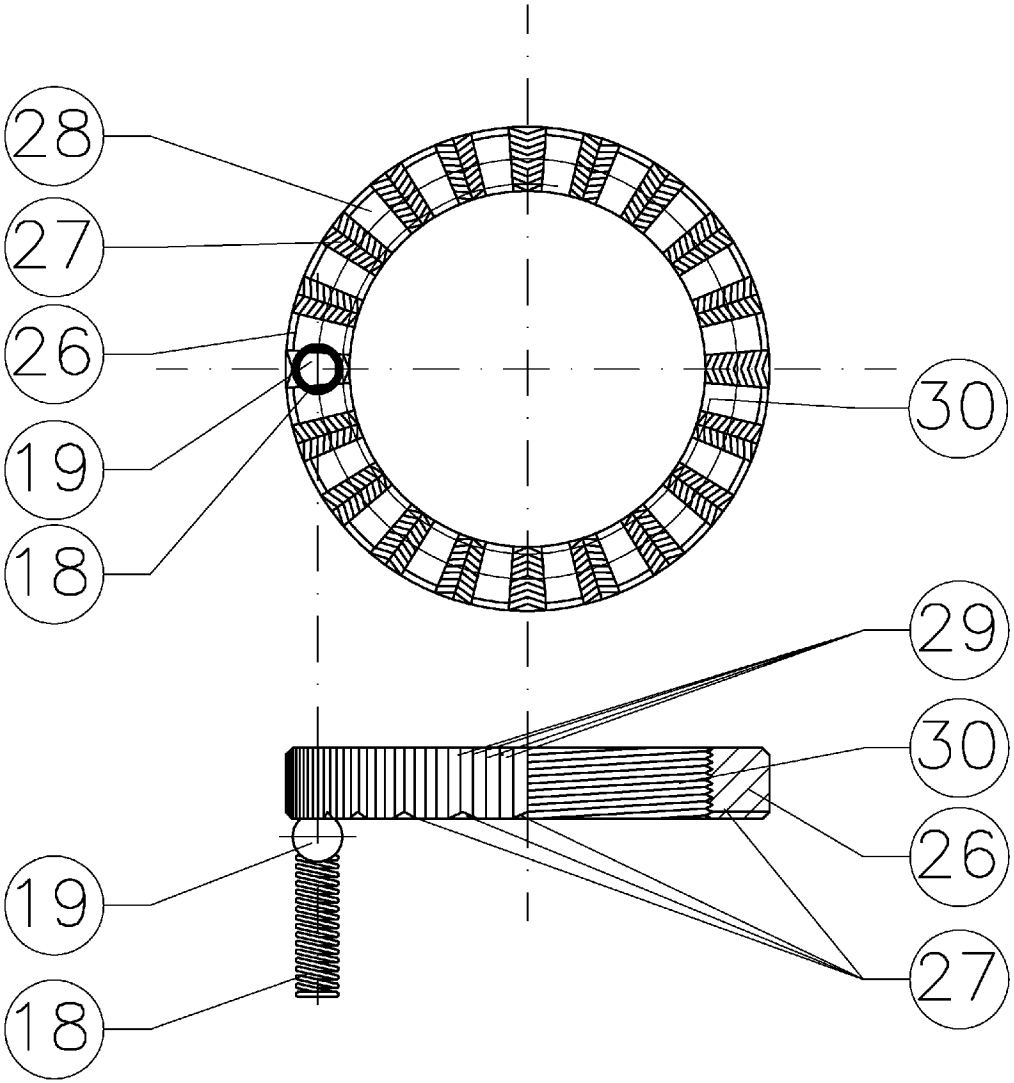
FIG. 5 A view from below of an adjusting nut of the trimming and sizing device FIG. 6 A partially sectional side view of the adjusting nut with locking element as per FIG. 5.

As can be seen in FIG. 2 and FIG. 3, the upper bushing 25 is provided with an external threaded section 31 preferably designed as a fine thread. The bushing 25 provided with an external threaded section 31 is received by means of a corresponding internal thread 30 of an adjusting nut 26 that is coaxially arranged with the threaded rod 5, as depicted in FIG. 6, which is integrated in the upper section 6.2 of the trimmer holder 6 of the trimming and sizing device. In order to integrate the ring-shaped adjusting nut 26 in the trimmer holder 6 depicted in the embodiment, the upper section 6.2 is provided with a corresponding opening, in particular slot-shaped opening. The adjusting nut 26 protrudes partially above the upper section 6.2 of the trimmer holder 6 in a radial direction so that it is possible to access and turn the adjusting nut 26 from outside of the device.

Alternatively, the adjusting nut 26 can for example be provided with a polyhedral external contour, preferably a hexagonal external contour, so that it can, for example, be operated using an open-ended wrench. At the same time, it is possible to design the dimensions of the adjusting nut 26 in such a manner that it does not protrude outside of the upper section 6.2 of the trimmer holder 6.

According to a further embodiment of the adjusting nut 26, it is possible to provide this with drilled blind holes distributed evenly around its external circumference into which it is possible to insert a pin with which to turn the adjusting nut 26. The bushing 25 is fixed in position in the upper section 6.2 of the trimmer 6 holder by means of a threaded pin 20 that extends vertically to the longitudinal axis of the threaded rod 5, to prevent any rotational movement of the bushing 25 relative to the threaded rod 5. For this purpose, the bushing 25 is provided with a groove 22 that extends parallel to the axis of the threaded rod 5. The threaded pin 20 engages in this groove 22. The freedom of the bushing 25 to move in a longitudinal direction along the threaded rod 5 is equally restricted by the threaded pin 20.

A tapped hole designed to receive the threaded pin 20 is preferably located on the side of the trimmer holder 6 facing that section of the adjusting nut 26 that protrudes above the upper section 6.2 of the trimmer holder 6. Furthermore, a drilled blind hole 21 is provided in the upper section 6.2 of the trimmer holder 6 that is arranged parallel to the axis of the threaded rod 5. Inside the drilled blind hole 21 there is a spring element 18, for example a coiled spring, designed as a compression spring as well as a locking element designed in the form of a ball 19. Instead of a ball, it is also possible to use a cylindrically shaped element with a curved end face as a locking element. For instance, it is also conceivable to use an essentially mushroom shaped locking element without impairing the function. Designed as a coiled spring the spring element 18 is supported at one end by the floor of the drilled blind hole 21 and presses the locking element designed as a ball 19 against the underside of the adjusting nut 26 with its other end. When ejecting a primer out of the base 16 of the cartridge case 2, which leaves an opening 17 in the base 16 of the cartridge case 2, the act of ejecting the primer by means of the decapping pin 15 briefly generates a pressure force. The cartridge case 2 is pressed into the die body 14 to size the cartridge case 2. The pressure force generated when ejecting the primer is absorbed by the threaded rod 5 and the lock nut 11, and transmitted to the flange-shaped edge of the stop bushing 9. The stop bushing 9 is in turn supported via its flange-shaped edge by the upper section 6.2 of the trimmer holder 6. This design embodiment prevents the forces being transmitted to the external threaded section 31 of the bushing 25 or rather the internal thread 30 of the adjusting nut 26.

Figure 4:
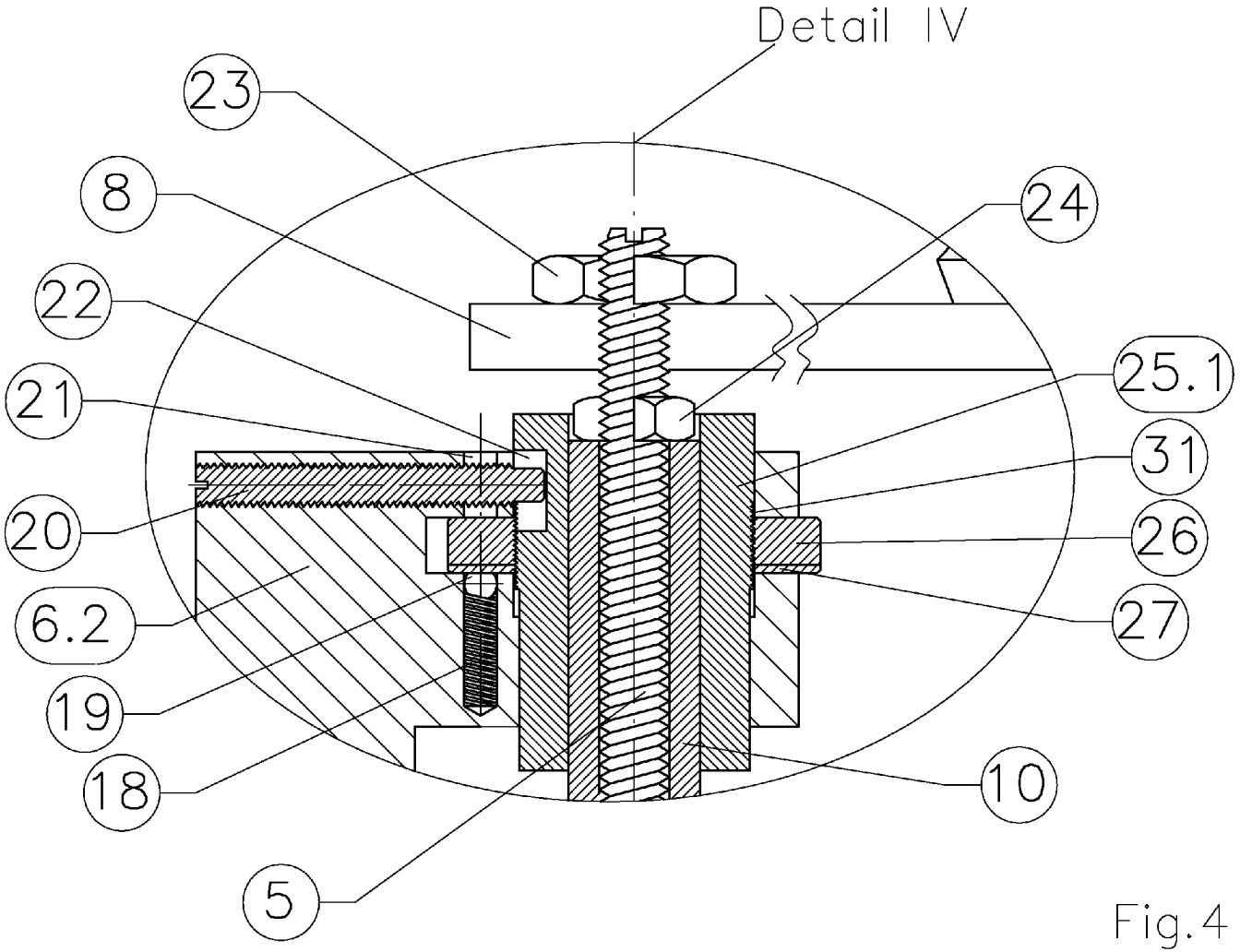
FIG. 4 A detailed view IV of an upper section of a trimmer holder of a second design embodiment of the trimming and sizing device as per FIG. 1

The drawing in FIG. 4 shows a detailed view IV depicting an upper section 6.2 of the trimmer holder 6 of a second embodiment of the trimming and sizing device as per FIG. 1. This embodiment differs from the first described embodiment as per FIG. 2 and FIG. 3 in as much that it does not require the stop bushing 9 with a flange-shaped edge. Instead, a bushing 25.1 coaxially arranged with the threaded rod 5 extends in an axial direction of the drilled blind hole at least as far as the total axial extension of the upper section 6.2 of the trimmer holder 6. This bushing 25.1 receives the plain bush 10, which encloses the threaded rod 5. In the same manner as the bushing 25 described in the first embodiment example, the bushing 25.1 is also provided with groove 22 that extends parallel to the axis of the threaded rod 5. The threaded pin 20 engages in this groove 22 so that the bushing 25.1 is secured to prevent it twisting. The freedom of the bushing 25.1 to move in a longitudinal direction along the threaded rod 5 is equally restricted by the threaded pin 20.

As described above, the bushing 25.1 is provided with an external thread 31, which is engaged with the internal thread 30 of the adjusting nut 26 so as to facilitate achieving a fine adjustment of the axial position of the cutter 12 by turning the adjusting nut 26. Turning the adjusting nut 26 effects a relative movement of the bushing 25.1 in relation to the upper section 6.2 of the trimmer holder 6. Together with the bushing 25.1 the position of the plain bush 10 received in the bushing 25.1 as well as that of the threaded rod 5 also changes. When ejecting the primer out of the cartridge case 2, the act of ejecting the primer by means of the decapping pin 15 briefly generates a pressure force. When ejecting the primer this pressure force is transmitted by the threaded rod 5 and the lock nut 11 to the bushing 25.1 or rather to its external thread 31 and the internal thread 30 of the adjusting nut 26, which are in turn supported at the upper section 6.2 of the trimmer holder 6.

The drawings in FIG. 5 and FIG. 6 show the adjusting nut 26 when viewed from below as well as in a partially sectional view. As can be seen in the drawing in FIG. 5 the adjusting nut 26 is provided with recesses 27 arranged and distributed evenly on its underside in a circumferential direction that extend in a radial direction across the entire width of the underside. The adjacent recesses 27 are separated from one another by plane surfaces 28 on the underside of the adjusting nut 26. The drawing in FIG. 6 shows how the coiled spring 18 presses the ball 19 into one of the recesses 27 by means of spring force to secure the adjusting nut 26 in position. Knurling 29 is provided on the outside circumference of the adjusting nut 26 to provide additional grip when operating the adjusting nut 26.

The fundamental mode of operation of sizing and trimming of this trimming and sizing device is known from the DE 10 2010 048 117 A1 or rather the corresponding Patent U.S. Pat. No. 8,408,112 B2, which are hereby incorporated by reference. However, the described trimming and sizing device according to the present disclosure differs from the device described in the DE 10 2010 048 117 A1 by the embodiment of a means to simplify the setting of the vertical position of the cutter 12 in combination at the same time with the highest accuracy when setting the required length to which the cartridge case 2 is to be shortened at the bullet end.

Turning the adjusting nut 26 integrated in the trimming and sizing device in its circumferential direction to the left or right results in transposing the ball 19 from one recess 27 to an adjacent recess, into which it clearly perceptibly and audibly engages. This ensures the user is made aware of the individual steps when making settings, which in conjunction with the pitch of the internal thread of the adjusting nut 26 or rather of the external threaded section 31 of the bushing 25 or the bushing 25.1, make it possible to precisely set the axial position of the cutter 12. This embodiment makes it possible to make settings in steps within a range of hundredths of a millimeter (in a range of thousandths of an inch steps). The size of the setting step depends on the thread lead on the bushing 25 or rather 25.1 as well as the adjusting nut 26. In addition, the size of the setting step is also influenced by the number of recesses 27 as well as the number of plane surfaces 28 between the recesses 27, as shown in FIG. 5.

When performing the trimming operation by turning and simultaneously pressing down on the crank handle 8 the cartridge case 2 is shortened by the cutter 12 to the length appropriate to the corresponding caliber. The maximum depth the cutter 12 can achieve is restricted by the bushing 25 or rather the bushing 25.1, which serves as an end stop for the crank handle 8. In using the adjusting nut 26 it is possible to set the end position of the cutter 12 in relation to the base 16 of the cartridge case 2 that the cutter 12 reaches at the end of the trimming procedure; in other words, with the adjusting nut 26 it is possible to set the minutest of axial distances that the cutter 12 can travel in relation to the base 16 of the cartridge case 2 when trimming. According to the present disclosure, this embodiment guarantees precision, reproducible shortening of the cartridge case 2.

LIST OF REFERENCE SIGNS

1 Case holder
2 Cartridge case
3 Expander die
4 Loading press
4.1 Pressing ram
5 threaded rod
6 Trimmer holder
6.1 Lower section of the trimmer holder 6
6.2 Upper section of the trimmer holder 6
7 Lock nut of cutter 12
8 Crank handle
9 Stop bushing
10 Plain bush
11 Lock nut of plain bush 10
12 Cutter
13 Clamping screw
14 Die body
15 Decapping pin
16 Base of cartridge case 2
17 Opening in base 16
18 Coiled spring
19 Ball
20 Threaded pin
21 Drilled blind hole
22 Groove

23 Lock nut of crank handle 8
24 Lock nut of plain bush 10
25 Bushing
25.1 Bushing
26 Adjusting nut
27 Recess
28 Surface on underside of adjusting nut 26
29 Knurling
30 Internal thread of adjusting nut 26
31 External threaded section

The invention claimed is:

1. A cartridge case processing device, comprising:

a trimmer holder comprising a first section that receives a die body and a second section that receives a shaft guided by a bushing and having a crank handle arranged thereon, a cutter, an expander die and a decapping pin being arranged on and coaxial to said shaft, wherein an adjusting nut accessible from an exterior is integrated into said second section, coaxial to said shaft and in a recess of said second section, rotation of said nut relative to said shaft effecting a relative movement of said bushing relative to said second section and an adjustment of a position of said cutter.

2. The device of claim 1, wherein said adjusting nut engages an external threaded section provided on said bushing.

3. The device of claim 1, wherein said adjusting nut is provided with a circular external contour.

4. The device of claim 1, wherein said adjusting nut is provided with a polyhedral external contour.

5. The device of claim 1, wherein said adjusting nut is provided with a hexagonal external contour.

6. The device of claim 1, wherein said adjusting nut partially protrudes out of said second section.

7. The device of claim 1, wherein a position of said adjusting nut is step-wise adjustable.

8. The device of claim 1, wherein a position of said adjusting nut is continuously adjustable.

9. The device of claim 1, wherein a locking element that is form-lock engageable with the adjusting nut is arranged in said second section.

10. The device of claim 9, comprising a spring element that applies a pressure to said locking element, said locking element being pressed against a radially outward extending surface of said adjusting nut provided with recesses.

11. The device of claim 10, wherein said recesses are interposed by intermediate, plane surfaces.

12. The device of claim 10, wherein said locking element is provided with an at least partially curved surface engageable by any one of said recesses.

13. The device of claim 9, wherein said locking element is designed as a ball.

14. A cartridge case processing device, comprising:

a supporting portion;

a rotary bearing;

a cutter mounted on a shaft rotatably mounted, via said rotary bearing, in said supporting portion;

a cartridge holding portion comprising a hollow that receives a cartridge case to position said cartridge case relative to said supporting portion;

an adjusting mechanism that adjusts a position of said rotary bearing relative to said supporting portion and defines a maximum distance of said cutter from said supporting portion in a longitudinal direction of said shaft; and a decapping pin coaxially mounted to an end portion of said shaft.

15. The device of claim 14, wherein:

said shaft extends into said hollow, coaxially to an axis of symmetry of said hollow.

16. The device of claim 14, wherein:

said supporting portion comprises a groove; and said adjusting mechanism comprises a nut that extends into said groove.

17. The device of claim 16, wherein:

said nut comprises a plurality of recesses arranged at regular intervals.

18. The device of claim 14, wherein:

said cartridge holding portion is releasably mounted to said supporting portion.

19. The device of claim 14, wherein:

said adjusting mechanism defines said maximum distance in a step-wise fashion.

* * * * *